United States Patent [19]

Mack

[11] Patent Number: 4,845,935

[45] Date of Patent: Jul. 11, 1989

[54] METHOD AND APPARATUS FOR THREADING ROVING INTO A RUNNING SET OF DRAFTING ROLLS

[75] Inventor: Karl-Heinz Mack, Wilhelm, Fed. Rep. of Germany

[73] Assignee: Zinser Textilmaschinen GmbH, Ebersbach/Fils, Fed. Rep. of Germany

[21] Appl. No.: 80,450

[22] Filed: Jul. 31, 1987

[30] Foreign Application Priority Data

Aug. 2, 1986 [DE] Fed. Rep. of Germany ..... 3626268

[51] Int. Cl.[4] ..... D01H 15/00

[52] U.S. Cl. ..... 57/261

[58] Field of Search ..... 57/261, 263, 268, 328, 57/315, 78, 80, 85

[56] References Cited

U.S. PATENT DOCUMENTS

| | | | |
|---|---|---|---|
| 4,438,622 | 3/1984 | Pons | 57/261 |
| 4,503,662 | 3/1985 | Horiuchi et al. | 57/261 |
| 4,535,944 | 8/1985 | Nakahara et al. | 57/263 X |
| 4,543,776 | 10/1985 | Seiki et al. | 57/261 |
| 4,619,109 | 10/1986 | Suzuki et al. | 57/328 X |
| 4,620,413 | 11/1986 | Anahara et al. | 57/261 |

FOREIGN PATENT DOCUMENTS

| | | |
|---|---|---|
| 2702745 | 7/1978 | Fed. Rep. of Germany . |
| 3218660 | 8/1983 | Fed. Rep. of Germany . |
| 3226151 | 5/1984 | Fed. Rep. of Germany . |

OTHER PUBLICATIONS

DE-Z Melliand Textilberichte, 6, 1984, S.379-383.

*Primary Examiner*—Donald Watkins
*Attorney, Agent, or Firm*—Herbert Dubno; Ronald Lianides

[57] ABSTRACT

In the threading of roving coming from a roving bobbin into a running set of drafting rolls of a work station of a spinning machine, the beginning end of the roving coming from the roving bobbin is grasped and brought into the set of drafting rolls bypassing at least the first (upstream-most) pair of rolls and is delivered to the drafting rolls downstream thereof. Only then is the roving fed into the set of drafting rolls bypassing at least the first pair of rolls inserted laterally in the preceding (bypassed) roll pair or pairs from a side of the free or unjournaled end of the upper roll.

19 Claims, 7 Drawing Sheets

Fig.1a
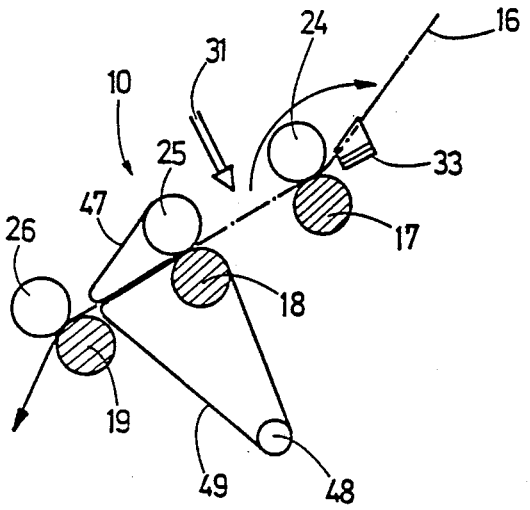
Fig.1b
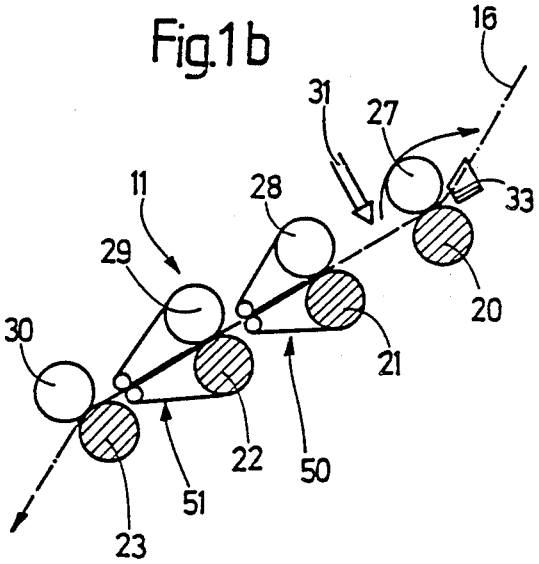
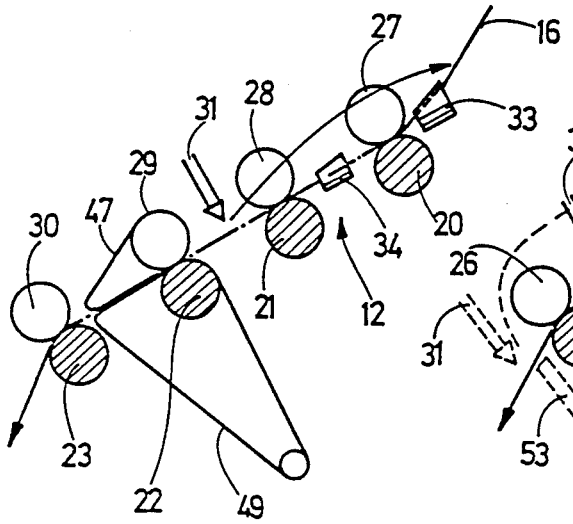
Fig.1c
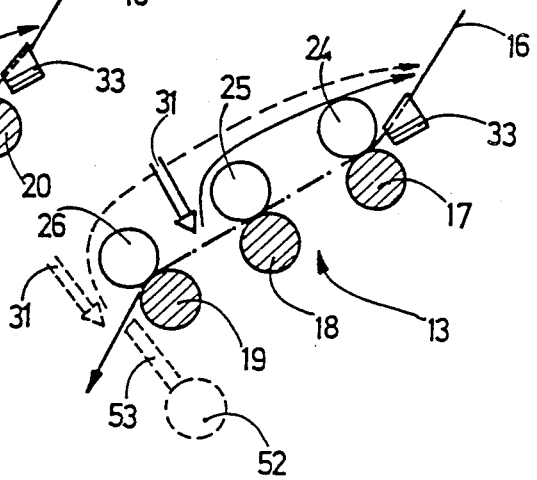
Fig.1d 64
62
63
69
31
71
68
66
65
67
72
70
77
76
74
37
38
75a
39
73
75
36

Fig. 8a
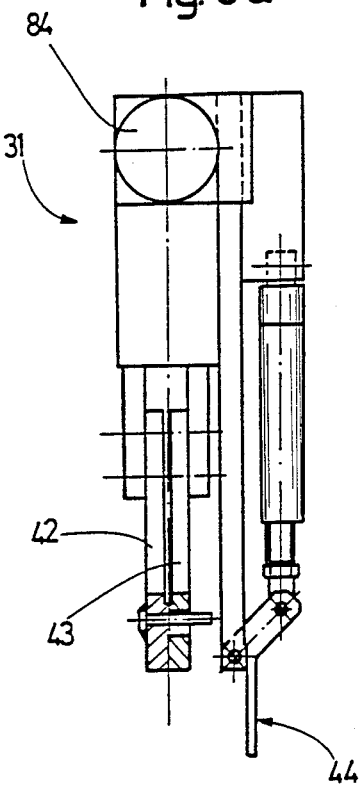
Fig. 8b
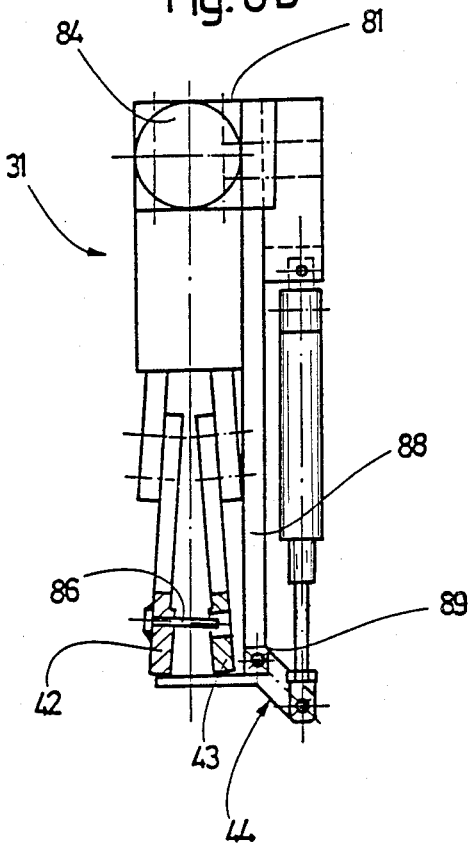
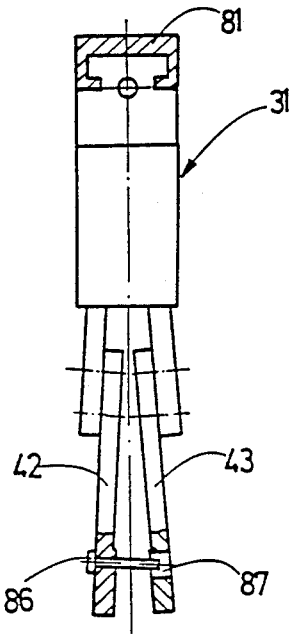
Fig. 9

METHOD AND APPARATUS FOR THREADING ROVING INTO A RUNNING SET OF DRAFTING ROLLS

FIELD OF THE INVENTION

My present invention relates to a method and apparatus for threading the rolls of a running set of drafting rolls with roving or yarn from a roving bobbin.

BACKGROUND OF THE INVENTION

A spinning or twisting machine generally has a plurality of work stations. Each of the working stations is provided with a set of drafting rolls with at least three roll pairs in each set of drafting rolls. Each roll pair has a lower driven cylinder which passes through the machine in the longitudinal direction and is common to at least a number of work stations, and an upper roll individual to each work station.

In a spinning machine, e.g. a ring spinning machine, in which each work station is provided with a set of drafting rolls, after the roving on a roving bobbin has been used up, the empty roving bobbin must be replaced by a full roving bobbin. Then the roving must be threaded into the set of drafting rolls before a spinning process can begin again. The roving must be fed through the set of drafting rolls without halting the drive of the set of drafting rolls.

In the past this threading has customarily been performed with the set of drafting rolls open and with a supporting arm carrying the upper roll in a swung-up position.

The path of the roving into the set of drafting rolls is then clear so that the leading end of the roving is guided in by a roving guide normally upstream of the set of drafting rolls and runs through the entire set of drafting rolls.

However when the roving feed is started in this way usually the roving feed at the adjacent work station is disturbed since, as is usually the case, the upper rolls can be paired in so-called twin press rolls with the rolls of an adjacent station and are arranged, in pairs on the support arm.

OBJECTS OF THE INVENTION

It is an object of my invention to provide an improved method and apparatus for threading roving into a running set of drafting rolls which will overcome these drawbacks.

It is also an object of my invention to provide an improved method and apparatus for threading roving into a running set of drafting rolls with which it is possible to thread the roving automatically without opening the set of drafting rolls and without disturbing adjacent running sets of drafting rolls.

SUMMARY OF THE INVENTION

These objects and others which will become more readily apparent hereinafter are attained in accordance with my invention in a method and apparatus for threading roving from a roving bobbin into a running set of drafting rolls at a work station of a spinning or twisting machine.

According to my invention, the leading end of the roving coming from the roving bobbin is grasped and brought into the set of drafting rolls bypassing at least a first roll pair and is delivered to the set of drafting rolls downstream of the first pair of rolls. Only then is the roving inserted laterally in the preceding, previously bypassed roll pair or pairs from the unjournaled or free end side of the upper roll.

The location at which the roving is fed into the set of drafting rolls is chosen according to engineering considerations. On the one hand, the location must be satisfactorily accessible for changing or delivering the roving while, on the other hand, reliability must be provided so that the roving runs reliably from this position into the remaining set of drafting rolls downstream thereof. Otherwise, there is a danger of clogging up by forming a wad or ball of roving.

Moreover, the position at which the roving is delivered to the set of drafting rolls should not have a high operating speed since a comparatively high loss of roving can then occur during the threading.

According to the invention, the leading end of the roving can be fed first into the roll pair which is provided with a belt and is furthest upstream in the running direction of the roving.

This usually is a position upstream of the first main drawing field. In this region, sufficient space is available for threading roving while on the other hand a reliable transport of the input roving is guaranteed in the following portions of the belt guide.

The leading end of the roving can be fed into a suction device downstream of the roll pairs and subsequently laterally inserting the roving into the roll pair or pairs upstream of this device so that usually there are no limits because of space considerations on the introduction of roving into the set of drafting rolls. On the other hand, there is a disadvantage: namely, that during the threading a comparatively large amount of roving is lost.

The incoming new roving can be delivered to the set of drafting rolls to thread the new roving while an end of another piece of roving is still running into the set of drafting rolls from another nearly completely used roving bobbin.

Thus a continuous feed of roving in the set of drafting rolls can result while the reliability is increased so that newly threaded roving runs through the set of drafting rolls free of problems.

The delivery of the leading end of the roving to the set of the drafting rolls is monitored, and only after the roving has traveled into the set of downstream drafting rolls, is an insertion of the roving into the bypassed roll pair or pairs performed. Thus it is guaranteed that a satisfactory operation of the roving threading will occur and that no wads or balls of roving are formed, particularly at the entrance or feed roll pair.

In an advantageous apparatus designed to perform the method according to my invention, means for grasping and guiding the roving are provided which grasp the leading end of the roving coming from a roving bobbin. The gripper brings the roving into the set of drafting rolls and delivers the roving to a pair of rolls. Then the gripper guides the roving into the pair of drafting rolls, bypassing at least the first roll pair and subsequently threads the roving laterally in at least the first roll pair from the free or unjournaled end side of the upper roll.

Advantageously each of the sets of drafting rolls is provided with at least one roving guide which has a lateral feed slot. Thus the roving can not only be threaded into the roll pair from the side but also into the roving guide from the side.

The means for grasping and guiding the roving can be the components of a traveling servicing device positionable at the individual work stations.

By "components" of the servicing device I mean advantageously the gripper arm or supporting arm, a clamping gripper for grasping the roving and various positioning drives and supporting elements required to properly orient and position the clamping gripper.

The means for grasping and guiding the roving can include a clamping gripper which is shiftable into three configurations: a closed clamping configuration, an open free configuration and an intermediate configuration which forms a guiding eye for the roving.

The clamping gripper can contain two clamping rollers movable toward and away from each other which are drivable for roving transport. A drive wheel which is positionable at a roll of a roll pair can be actively connected with one of the clamping rollers of the clamping gripper to drive it.

Alternatively, two pincerlike gripping elements can be provided as a clamping gripper. They are movable in the direction of the roving and grasp the roving with the gripping elements mutually opening and closing toward and always from each other. At least one of the pincerlike gripping elements can be associated with a closing element pivotable to be oriented transverse to the gripping prongs provided on the gripping elements to form a guiding eye for the roving.

Means for detection of the roving motion including a speed meter connected to the gripping rollers can be provided.

BRIEF DESCRIPTION OF THE DRAWINGS

The above and other objects, features and advantages of my invention will become more readily apparent from the following description, reference being made to the accompanying highly diagrammatic drawing in which:

FIGS. 1*a* to 1*d* are schematic cross sectional views showing different sets of drafting rolls and different arrangements for performing the method according to my invention with these sets of drafting rolls;

FIGS. 8*a* and 8*b* are partially sectioned plan views of the clamping gripper in different operational positions as seen in the direction of the arrow VIII of FIG. 7; and FIG. 9 is a schematic plan view of a additional gripper element of the clamping gripper of FIG. 7.

SPECIFIC DESCRIPTION

Figure 2:
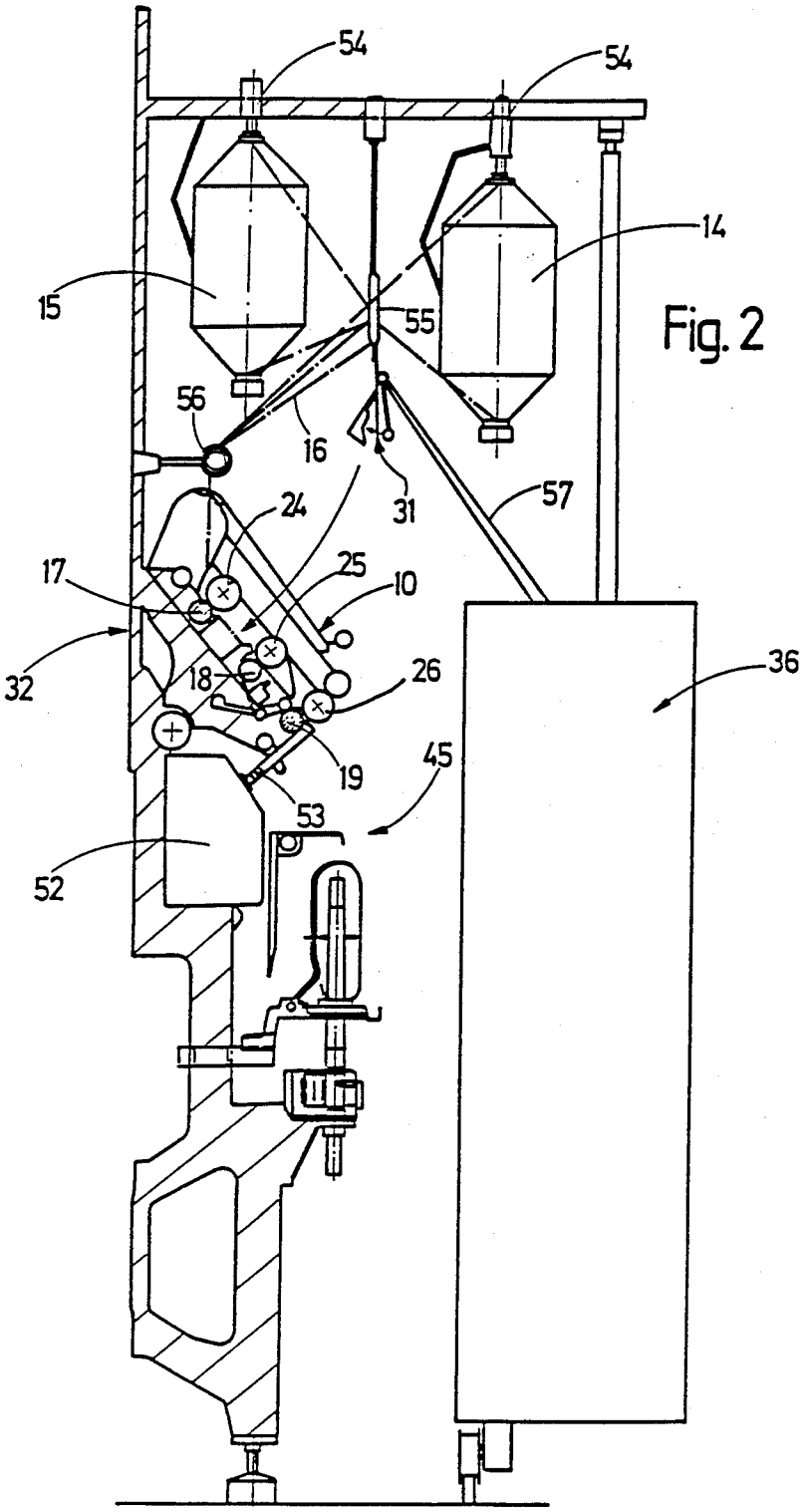
FIG. 2 is a side cross sectional view through a ring spinning machine with traveling servicing device which is equipped with means for threading roving.

Sets of drafting rolls are shown in FIGS. 1*a* to 1*d* similar to those used in a spinning machine, for example in the ring spinning machine 32 which is shown in FIG. 2. Roving 16 which is drawn from a roving bobbin 14 or 15 is drawn to the desired yarn size in the set of drafting rolls. The roving leaving the set of drafting rolls is spun to a yarn on a spindle ring 45.

FIG. 1*a* shows a frequently used set of drafting rolls 10 having three roll pairs 17 and 24, 18 and 25 and 19 and 26. Each of these roll pairs has a lower driven cylinder 17, 18 and 19 extending through the machine in the longitudinal direction and connected to a central drive, the lower rolls extending over a plurality of work stations on one machine side and which cooperate with the associated upper rolls 24, 25 and 26.

The upper rolls 24, 25, 26 are formed like so called twin press rollswwhich are held by a supporting arm 46. A common twin press roll is provided for two adjacent work stations which comprises the upper rolls 24 and 24', 25 and 25', and 26 and 26' of the adjacent work stations. Thus each of the thinning or paired rolls has a journaled and an unjournaled end.

The lower cylinder rolls 17, 18, 19 are driven with increasing speed so that the roving passing on its way through the set of drafting rolls 10 is pulled or stretched.

The first roll pair 17 and 24, the so called feed roll pair, runs with reduced speed.

The so called predrawing field is located between the feed and second roll pairs 17, 24 and 18, 25.

The main drawing field is located between the second and third roll pairs 18, 25 and 19, 26. In this main drawing field the roving to be drawn is fed by a belt guide which comprises an upper belt 47 slung about a nonillustrated guide rail and upper roll 25, the nonillustrated guide rail and also a lower belt 49 slung about a turnaround guide 48.

The guide rails are so positioned that the upper belt 47 and the lower belt 49 have portions running parallel to each other in the main drawing field. A funnel shaped roving guide 33 is located upstream of the entrance or feed roll pair 17, 24.

The particular form of the set of drafting rolls is oriented to the special application and to the material to be worked.

Additional examples of drafting roll sets are shown in FIGS. 1*b* to 1*d*.

For example FIG. 1*d* shows a set of drafting rolls 13 substantially similar to the set of drafting rolls according to FIG. 1*a*, which has however no belt guide.

FIG. 1*b* and FIG. 1*c* show, contrastingly, sets of drafting rolls 11 and 12 which have four roll pairs, so called four cylinder drafting rolls.

These sets of drafting rolls 11 and I2 have four lower driven cylinders 20, 21, 22 and 23 passing through the machine in the longitudinal direction which are assooiated with corresponding upper rolls 27, 28, 29 and 30 which are usually constructed as twin press rolls.

In the embodiment according to FIG. 1*b*, both main drawing fields are provided with belt guides 50, 51.

In the embodiment according to FIG. 1*c*, in contrast, only the final main drawing field is provided a belt guide comprising an upper belt 47 and a lower belt 49 corresponding to FIG. 1*a*. In this example an additional roving guide 34 is provided in the predrawing field after the entrance or feed roll pair 20, 27.

As is indicated in FIG. 1*d* and as is also shown in FIG. 2, a suction device 52, 53 is usually connected immediately downstream of the set cf drafting rolls 10, 11, 12 and 13 which comprises a suction pipe 53 provided in the vicinity of each work station and a low pressure duct 52 connected to a vacuum source and the suction pipe 53 and extending alongside the drafting rolls in the longitudinal direction of the machine.

The suction opening at the end of the suction pipe 5 is located directly adjacent the outlet roll pair 19, 26.

Upon a yarn break, the, portion of roving fed further from the set of continuously running drafting rolls is pulled in the suction device 52, 53 until a nonillustrated roving stopping device activates, which halts the additional transport of the roving in spite of the continuous running of the sets of drafting rolls 10, 11, 12 and 13.

The set of drafting rolls 10 pulls the roving away from the roving bobbins 14, 15. The roving bobbins 14, 15 are suspended on the hangers 54 above the set of drafting rolls 10. The roving 16 pulled away is fed over the roving guide 55 and 56 to the set of drafting rolls 10.

When the roving supply from one roving bobbin 14 or 15 is used up, then the appropriate roving bobbin 15 or 14 is exchanged and the empty bobbin is replaced by a new full roving bobbin 14 or 15. The roving must then be fed anew into the set of drafting rolls 10.

The new roving bobbin 14 or 15 is suspended on the appropriate hanger 54 whereby the leading end of the roving is made available at a definite position.

In the embodiment of FIG. 2 the leading end of the roving 16 hangs free below the first roving guide 55.

The feed of the roving to the next roving guide 56 and the set of drafting rolls then occurs automatically by a traveling servicing device 36 which can travel along the spinning machine 32 and which is positioned as required at the appropriate work station.

The traveling servicing device 36 includes a gripper arm 57 provided with a positioning device which is provided with a clamping gripper 31.

The gripper arm 57 with the clamping gripper 31 grasps the leading end of the roving 16 and guides it around the roving guide 56 and into the set of drafting rolls 10. The process of threading into the set of drafting rolls 10 is illustrated in more detail later.

The continuously running set of drafting rolls 10 then pull the roving, which is drawn into the suction device 52, 53 until a spinning is initiated.

If the set of drafting rolls 10 is provided with a nonillustrated roving stopping device thus this roving stopping device is put out of engagement during the initial feed of roving and is again engaged after the roving is fed into the drafting rolls and then drawn into the suction device 52, 53.

The roving bobbin 14, 15 can be associated with a nonillustrated monitoring device which observes the roving supply on the roving bobbin 14, 15 and which signals the traveling servicing device 36 shortly before the roving is used up, which then performs a threading method before the roving of the roving bobbin being used is completely exhausted. During this threading method the old roving is cut at a very definite position by a nonillustrated cutter.

The threading of roving 16 of the new roving bobbin 14, 15 is performed in such a way that the set of drafting rolls 10 need not be opened.

Figure 3:
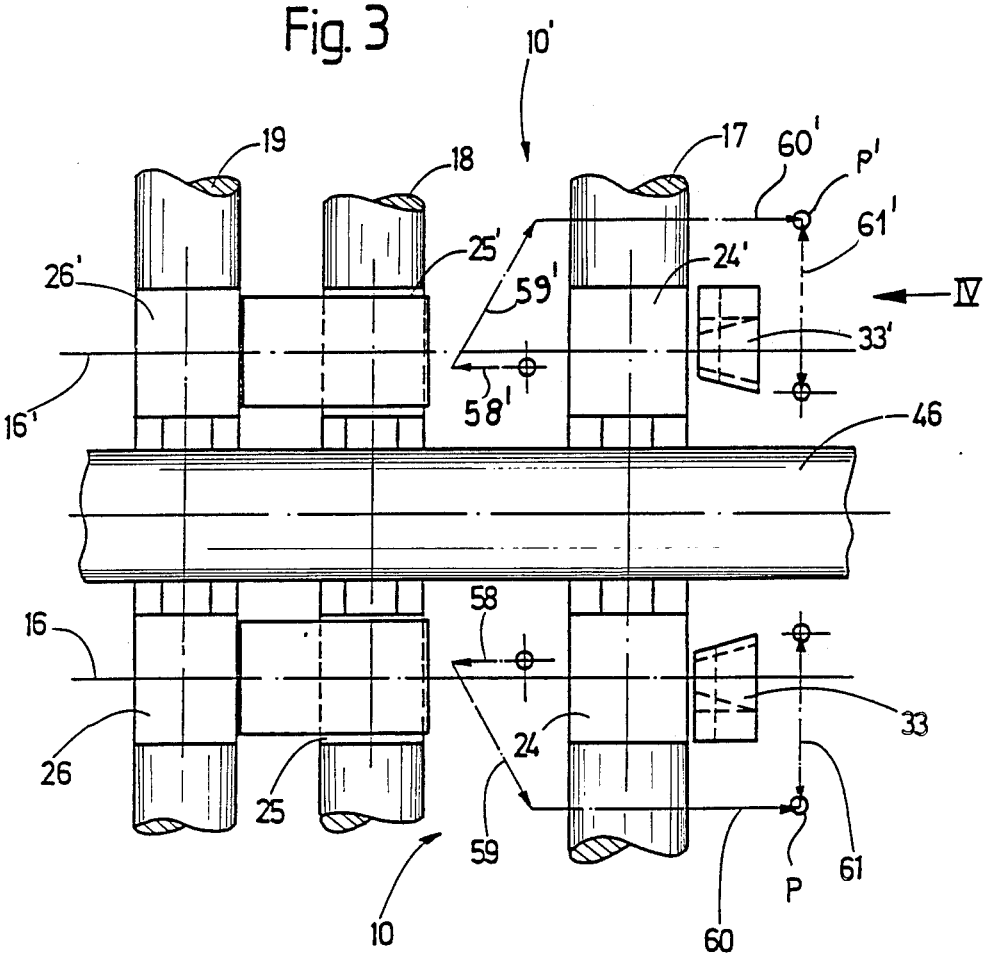
FIG. 3 is a top view of a set of drafting rolls with schematically shown operations of the means for engaging and guiding roving during threading.
Figure 4:
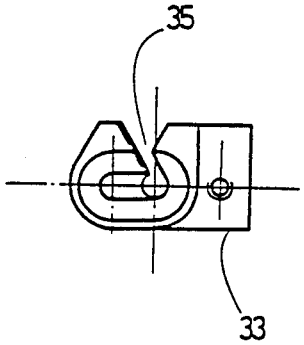
FIG. 4 is a side view of a roving guide taken in the direction of the arrow IV of FIG. 3.

This threading of the roving 16 is shown most clearly with the aid of the illustration in FIGS. 3 and 4. The clamping gripper 31 grasps the leading end of the roving 16 and then dips into the predrawing field between the feed or entrance rolls 17, 24 and the roll pair 18, 25 downstream thereof.

The gripper is then moved into the clamping gap between the rolls 18, 25 in the direction of the arrow 58 so that the leading end of the roving 16 is drawn in by this pair of rolls 18, 25.

The clamping gripper 31 then opens only far enough so that the gripping of the leading end of the roving 16 held in it is loosened, so that the clamping gripper 31 becomes a guide for the roving 16, which now feeds into the set of drafting rolls 10.

The clamping gripper 31 is then moved laterally and upwardly from the set of drafting rolls 10 (arrow 59) and moves upstream until in front of the entrance or feed roll pair 17, 24 and the roving guide 33, the path being indicated by the arrow 60.

After that, the clamping gripper 31 again goes deeper into the set of drafting rolls 10. Thus it moves far enough down so that the roving contacts on the lower cylinder roll 17. This motion is indicated by the arrow 61. With this motion the roving 16 is pulled between the roll pair 17, 24 and simultaneously also fed into the roving guide 33 through a lateral feed slot 35 formed therein.

When this threading has been finished the clamping gripper 31 completely opens and the roving 16 running into the set of drafting rolls 10 is completely released in the correct position and the gripper moves back in the opposite direction indicated by the arrow 61 from the set of drafting rolls 10.

As can be seen from FIG. 3 the clamping gripper 31 is positioned next in a position p or p′ which is spaced from the front or upstream side of the upper rolls 24, 25, 26 during the normal running of the roving. Likewise, the clamping gripper 31 is moved out in front of the roving guide 33 over this same path whereby the threading reliability is increased.

As can be seen from FIG. 3 the path of motion of clamping gripper 31 on one side is a mirror image of the path on the other side depending on which side of the twin press roll the initial feed is guided. The clamping gripper 31 and/or the gripper arm 57 carrying it and the associated element for performing the motion are so formed that they can move on both sides of the twin press rolls. The traveling servicing device 36 retains information about which work station of the spinning machine 32 it is located at and which motion must be performed.

In the initial threading and transfer, the downstream end of the roving is guided to a position in or near the set of drafting rolls at which the roll pair I8, 25 immediately following the entrance roll pair is satisfactorily accessible for that end of the roving. It is desirable also to shape the immediate vicinity of the set of drafting rolls where this end is received so that a highly reliable feed is attained and so that the roving correctly runs through the following parts of the set of drafting rolls. Thus that key location depends on the design used for the set of drafting rolls.

With the set of drafting rolls according to the embodiment shown in FIG. 1*b* the threading of the leading end of the roving 16 similarly occurs in the predrawing field to the rolls 21, 28 since the threading would be difficult in the other predrawing field because of the belt guides 50, 51 present. This belt guide 50, 51 provides moreover a high reliability so that once threaded in, the roving 16 runs through the set of drafting rolls 11 reliably.

In the set of drafting rolls according to the embodiment of FIG. 1*c* contrastingly, it is provided that the clamping gripper 31 is positioned in the first main drawing field upstream of the roll pair 22, 29. In this case the roving 16 subsequently, since it could be received by the rolls 22, 29 and/or the belt guides 47, 49, is guided laterally between the rolls 21, 28 and 20, 27 into the thread guide 34 provided with an appropriate lateral threading slot.

In the embodiment according to FIG. 1*d* the clamping gripper 31 is positioned upstream of the output roll pair 19, 26. The roving 16 is then threaded subsequently between the rolls 18, 25 and 17, 24 as well as into the roving guide 33 in the way described with the aid of FIG. 3.

As is indicated in FIG. 1*d* it is also possible to place the clamping gripper 31 at the suction device 52, 53 and subsequently thread the roving 16 from one side (the nonjournaled end side) between all roll pairs 19, 26 and 18, 25 and 17, 24 and in the roving guide 33. This threading of the leading end of the roving 16 in the suction device is basically required with the other set of drafting rolls according to FIGS. 1*a* to 1*c* which are provided with belt guides 47, 49; 50, 51. Thus then, additionally, it is provided that the guide elements of the belt guides 47, 49 and 50, 51 must be somewhat spread apart during the feed. In this case the traveling servicing device 36 must be equipped with a corresponding additional device which causes the spreading of the guide elements.

Figures 5, 5A, 5B:
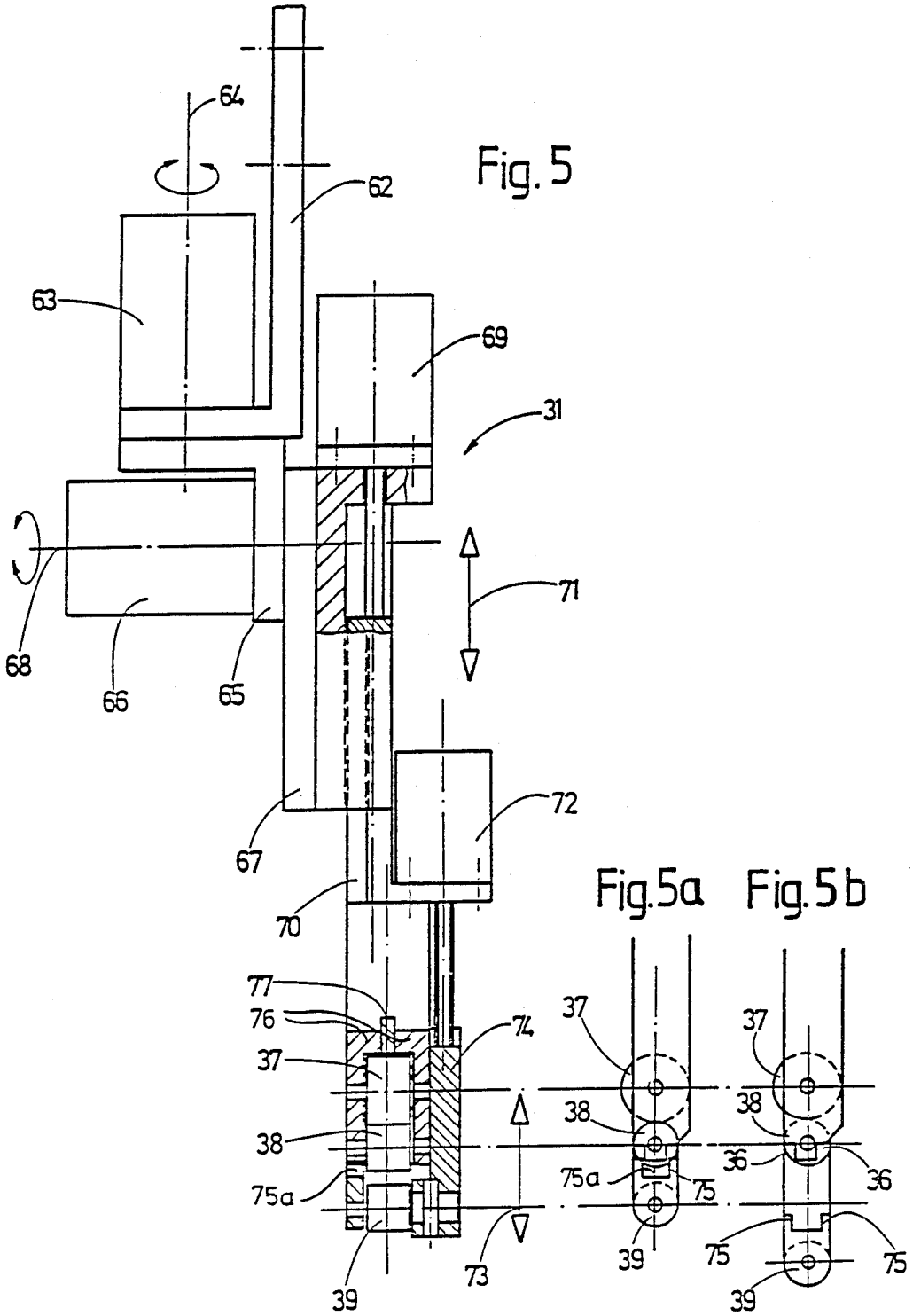
FIG. 5 is a schematic partially sectioned side view of a clamping gripper equipped with two clamping rollers.
FIGS. 5*a* and 5*b* are partial side views of a clamping gripper in different operating positions.
Figures 6, 6A:
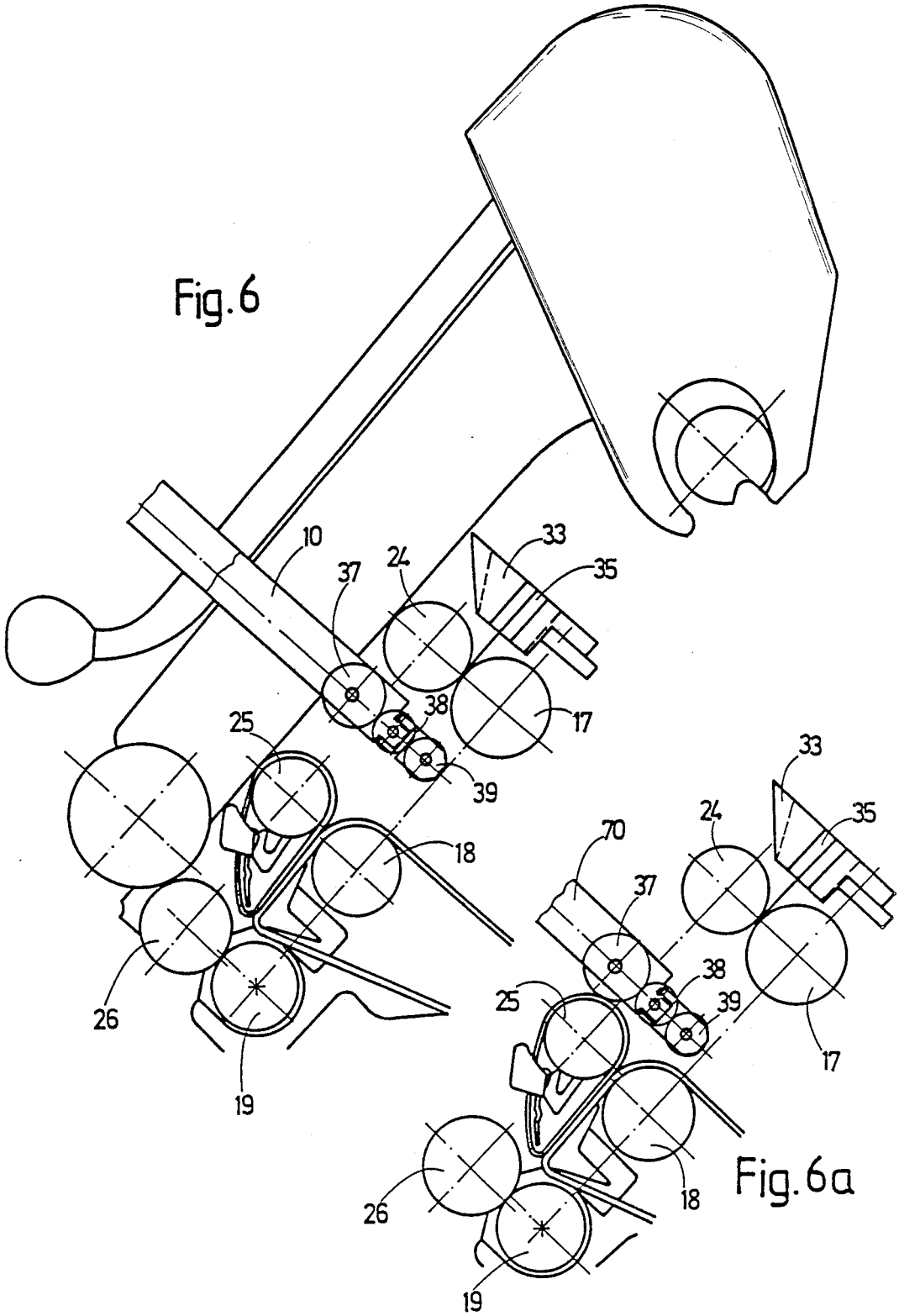
FIG. 6 is a side elevational view of a clamping gripper according to FIG. 5 in a first position inserted in a set of drafting rolls.
FIG. 6*a* is a cross sectional view of the set of drafting rolls and clamping gripper according to FIG. 5 in the next position in succession to that of FIG. 6.

In FIGS. 5 and 6 a first embodiment of a clamping gripper 31 is shown which is in a position to act as gripping and clamping element of the leading end of the roving and also as guiding element for the running roving. The clamping gripper 31 is attached with a mounting member 62 on a moving arm, for example the gripper arm 57 of the servicing device 36.

The mounting member 62 is provided with first positioning drive 63 with which the entire clamping gripper 31 is pivotable about one axis 64 (or a first axis 64) so that it is orientable with respect to the set of drafting rolls 10 with an appropriate rotation.

A supporting element 65 rotatable by the first positioning drive 63 is attached thereto and another supporting element 67 is attached by an additional second positioning drive 66 mounted on the supporting element 65.

The second positioning drive 66 can pivot the other supporting element 67 about another (or second) axis 68 which runs transverse to the first axis 64.

A third positioning drive 69 which is formed in this embodiment like a spindle drive is mounted on this other supporting element 67.

A supporting arm 70 is movable back and forth by this third position drive 69 in the direction of the double arrow 71. Two clamping rollers 38,39 are mounted on the supporting arm 70 of which one clamping roller 39 is movable back and forth in the direction of the double arrow 73 by a fourth positioning drive 72 mounted on the arm 70 and which is similarly formed like a spindle drive.

The other second clamping roller 39 is mounted on a slidable component 74 guided on the supporting arm 70. The component 74 receiving the clamping roller 39 is provided with two shoulder members 75 which are associated with guide piece 76 of the supporting arm 70 so that in a first position in which the clamping rollers 38 and 39 are slightly spaced apart as is shown in FIGS. 5 and 5*a*, a guiding eye configuration 75*a* is formed between the clamping rollers 38 and 39 which is bounded on one side by the component 74 and on the other side by the shoulders 75. A drive wheel 37 which is also mounted on the supporting arm 70 is actively engaged with the clamping roller 38.

The clamping gripper 31 is guided by the arm carrying it, for example the gripper arm 57, so that it grasps the leading end of the roving 16 at a predetermined position (FIG. 2).

The clamping gripper 31 is then inserted into the set of drafting rolls 10 and as is necessary, is provided so that it performs a motion during its positioning with which the roving 16 is slung around the roving guide 56.

The clamping gripper 31 is then brought into the correct position for a "right" or "left" set of drafting rolls 10 or 10' by the first positioning drive 63.

The path of motion corresponding to the arrows 58 to 61 and/or 8' to 61' is controlled then by the second and third positioning drives 66 and 69.

Next, the third positioning drive 69 is operated so that the clamping gripper 31 holding the leading end of the roving between the clamping rollers 38, 39 dips into the set of drafting rolls (FIG.6). By operation of the second positioning drive 66, the clamping gripper 31 is placed adjacent the roll pair 18, 25 following the entrance or feed roll pair. The drive wheel 37 engages against the upper roll 25 and/or against the belt 47 circling about it.

The drive wheel 37 which then is driven drives the clamping rollers 38 and 39 so that the leading end of the roving 16 is guided into the clamping gap between both rolls 18, 25 and is pulled into them. Subsequently, the fourth positioning drive 72 is operated so that the clamping rollers 38, 39 move into an intermediate position in which they maintain a spacing from each other and in which however the shoulder 75 and the component 74 together with the clamping rollers 38, 39 form the closed guiding eye 75*a* for the running roving 16.

By operation of the second positioning drive 66, the supporting arm 70 is again moved back from the drafting rolls 18, 25 so that the roving is pulled by the drafting rolls 18, 25 through the guiding eye formed by the clamping gripper 31. The clamping gripper thus performs the motion illustrated in FIG. 3.

When the clamping gripper 31 is located at the end of the path of the return motion in front of the roving guide 33 (the end of the motion indicated with arrow 60), the fourth positioning drive 72 is again operated so that the clamping rollers 38, 39 again contact each other and clamp the roving.

The clamping gripper 31 is then moved transverse to the set of drafting rolls 10, 10' so that it pulls the roving 16 into the entrance of feed roll pair 17, 24 and the roving guide 33.

After that the clamping gripper 31 opens completely, i.e. it is brought into a second fully open position (FIG. 5*b*) by operation of the fourth positioning drive 72. In this second open position the clamping rollers 38 and 39 and further spaced apart from each other that the first open position and the shoulders 75 are separted from the guide piece 76.

After release of the running roving 16, the clamping gripper 31 then moves into its initial position p or p'.

In practice it is enough to observe that the leading end of the roving 16 going from the clamping gripper 31 to the roll pair 18, 25 is reliably drawn in. In case it is not successfully drawn in, then the threading method should be interrupted and repeated again.

The monitoring of the successful drawing in of the roving can be performed by monitoring the path of the roving motion in a variety of ways. For example it is possible to provide a mechanical tension sensor in the path of the roving which is operated as soon as the roving is drawn into the set of drafting rolls when that portion of the roving is clamped between the set of drafting rolls and the roving bobbin.

It is also possible to locate an electro-optical roving detector at a position at which the roving must pass when it is successfully guided into the set of drafting rolls and engaged thereby.

In the embodiment according to FIG. 5 it is provided that the successful threading of the roving 16 in the set of drafting rolls 10 is directly monitored at the clamping gripper 31. The clamping gripper 31 is provided with rotational speed meter 77 which is associated with drive wheel 37. After positioning the arm 70, it is moved back with the drive wheel 37, for example into the position according to FIG. 6, in which the drive connection between the drive wheel 37 and the roll 25 is interrupted. At this point in time the rotational speed meter 77 then is activated. The rotational speed meter 77 indicates that the drive wheel 37 is running and this indicates that the drive wheel 37 is being driven by the clamping roll pair 38, 39, i.e. by the roving running in the set of drafting rolls 10.

Figure 7:
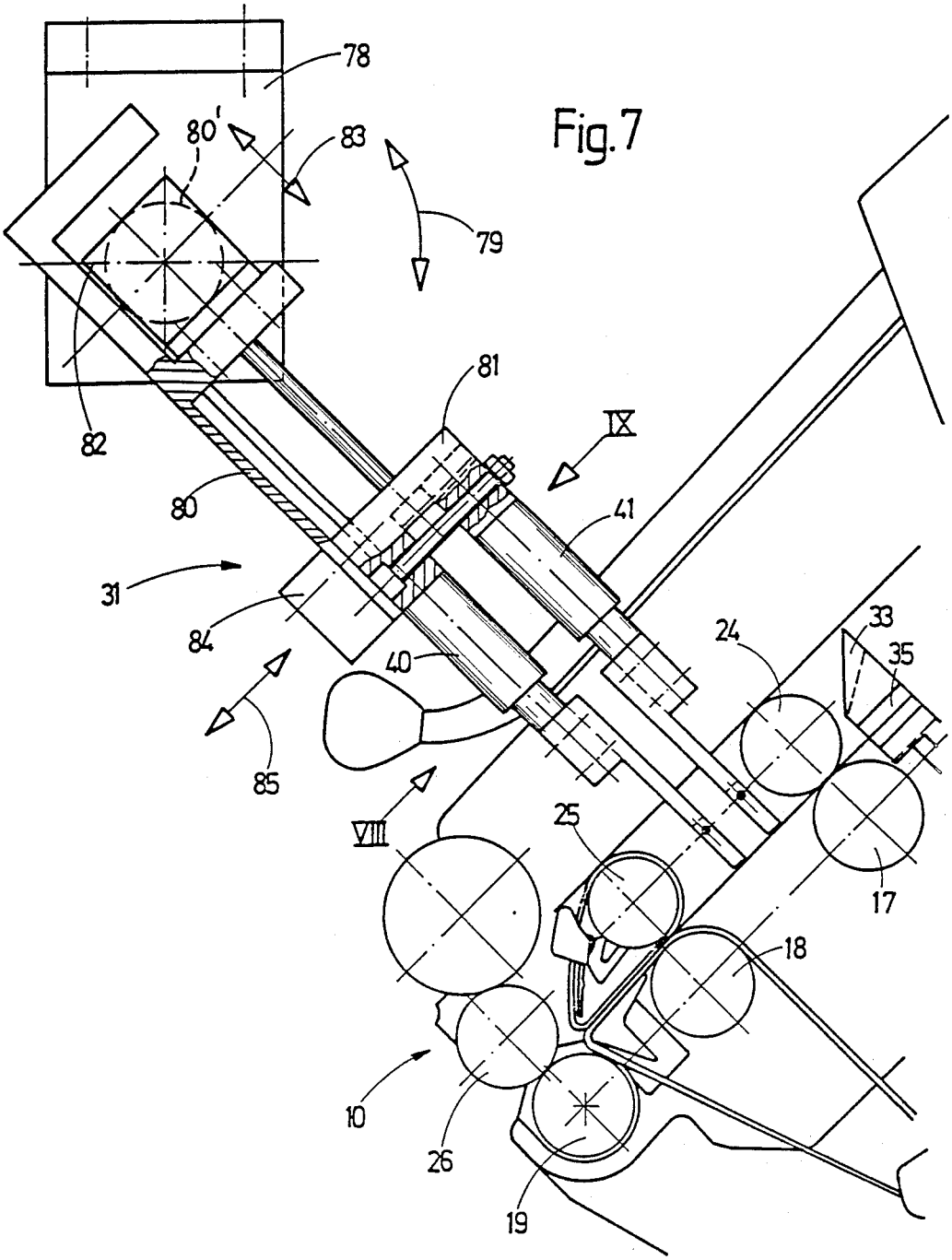
FIG. 7 is a partially sectioned schematic side view of another example of a clamping gripper inserted in a set of drafting rolls.

An additional embodiment of a clamping gripper 31 is illustrated in FIGS. 7 to 9, in which the gripper is attached by a holder 78 to an nonillustrated arm, e.g. the gripper arm 57 of the servicing device 36. One supporting element 80 movable in the direction of the arrow 79 about a transverse axis by a first adjusting drive 80' is attached on this holder 78.

Two gripping elements 40, 41 are mounted on this one supporting element 80 by a component 81 slidable in the longitudinal direction of the supporting element 80 and mounted thereon and movable back and forth in the direction of the double arrow 83 by a second adjusting drive 82.

The gripping element 40 is mounted fixed on the component 81 while the gripping element 41 is movable transverse to the motion path of the component 81 by a third adjusting drive 84 in the direction of the double arrow 85. Thus also here a spindle drive is used. The gripping elements 40,41 usually comprise two gripping prongs 42, 43 which are pivotable by a magnetic drive so that they either take a parallel clamping position or a spread released position (FIGS. 8*a*, 8*b* and 9).

In the region of the clamping surfaces the gripping prong 42 is provided with a pin 86 which is aligned with an opening 87 formed in the gripping prong 43.

At least one of the gripping elements 40, 41 is associated with a closing element 44 which is pivotable about an axis positioned on a bar 88 mounted on the component 81 so that it is positioned transversely in front of the end of the gripping prongs 42, 43 or parallel to them. With the closing element 44 closed, the gripping prongs 42, 43 together with the pin 86 form a guiding eye for the roving (FIG. 8*b*).

For a feed of the roving the clamping gripper 31 of the embodiment shown in FIGS. 7 to 9 grasps the leading end of the roving 16 at a definite position (FIG. 2). If necessary after positioning the roving 16 about a roving guide 56, the clamping gripper 31 moves into the vicinity of the set of drafting rolls 10. Thus the clamping gripper 31 is aligned by the first adjusting drive 80' so that it performs the motion (FIG.3) for a "right" or "left" set of drafting rolls 10, 10'.

By operation of the second adjusting drive 82, then the gripping elements 40, 41 are moved into the predrawing field of the set of drafting rolls 10 (FIG. 7).

In this position the gripping prongs 42, 43 of the gripping element 41 are opened after which this gripping element 41 is moved away by operation of the third adjusting drive 84 from the other gripping element 40.

After that the gripping prongs 42, 43 of the gripping element 41 are closed while those of the gripping element 40 are opened. Subsequently the gripping element 41 is moved toward the gripping element 40. In this way, and if necessary, repeating this procedure several times, a transport of roving occurs so that it reliably arrives in the entrance region between the roll pairs 18, 25.

After the leading end of the roving is fed into the roll pair 18, 25 the gripping prongs 42, 43 open while, however, the closing element 44 remains closed. The clamping gripper 41 now forms the guiding eye for the roving 16. In this position of the gripping prongs 42, 43 the clamping gripper 31 executes the motions 60 and 61 shown with the aid of FIG. 3 so that the roving 16 is fed into the rest of the set of drafting rolls. After that the closing element 44 is opened so that the roving 16 is completely released and the clamping gripper 31 is taken from the region of the associated set of drafting rolls 10, 10'. Also in this embodiment monitoring of a successful grasping of the leading end of the roving by the roll pair 18, 25 is performed. This can be performed by the already described optical, electrical or mechanical means or elements.

I claim:

1. An apparatus for threading of roving coming from a roving bobbin at any of a plurality of work stations of a spinning machine into a running set of drafting rolls having at least three roll pairs which each include an upper roll and a driven lower roll comprising:

at least one roving guide with a lateral feed slot for each of said sets of drafting rolls;

a clamping gripper which is part of a traveling servicing device positionable at the involved one of said work stations shiftable into three configurations, namely a closed clamping one of said configurations, an open free one of said configurations and an intermediate one of said configurations which forms a guiding eye for said roving for grasping and guiding said roving which grasps the leading end of said roving coming from said roving bobbin to facilitate bringing said roving into said set of drafting rolls bypassing at least a first one of said roll pairs and inserting said roving laterally in said roll pair or pairs bypassed from the free or unjournaled end side of said upper roll; and means for roving motion detection.

2. The apparatus as defined in claim 1 wherein said clamping gripper comprises:

two clamping rollers movable to and from each other which are drivable for transport of said roving; and a drive wheel which is connectable to a roll of one of said rll pairs and also connected with one of said clamping rollers of said clamping gripper.

3. The apparatus as defined in claim 1 wherein two pincerlike gripping elements are provided as said clamping gripper and are movable in the direction of said roving which is grasped by said gripping elements mutually opening and closing to and from each other and at least one of said pincerlike gripping elements is associated with a closing element pivotable transversely to the gripping prongs provided on said gripping elements.

4. A method of threading a roving coming from a roving bobbin at any of a plurality of work stations of a spinning machine into a running set of drafting rolls provided at each work station and having at least three roll pairs which each include an upper roll and a driven lower cylinder roll extending through said spinning machine in a longitudinal direction thereof, said method comprising the steps of:

(a) grasping a leading end of a roving coming from said roving bobbin;

(b) delivering said leading end of said roving to said set of drafting rolls;

(c) bypassing at least a first upstream roll pair of said set of drafting rolls and feeding said leading end of said roving into another roll pair of said set downstream of said first roll pair; and (d) subsequently threading said roving laterally into at least said first roll pair from a free side thereof.

5. The method defined in claim 4 wherein said leading end is fed into a roll pair furthest upstream in said set of drafting rolls which is provided with a belt guide.

6. The method defined in claim 4 wherein said leading end is fed into a suction device provided downstream of said set of drafting rolls and subsequently threading said roving laterally into said roll pairs of said sets.

7. The method defined in claim 4 wherein said leading end of said roving is fed into said set of drafting rolls while another roving from another nearly empty roving bobbin is still running through said set.

8. The method defined in claim 4, further comprising the step of monitoring said leading end of said roving to determine if said roving is feeding into said other roll pair and upon determining feeding of said roving, carrying out step (d).

9. An apparatus for threading a roving coming from a roving bobbin at any of a plurality of work stations of a spinning machine into a running set of drafting rolls provided at each work station and having at least three roll pairs which each include an upper roll and a driven lower cylinder roll extending through said spinning machine in a longitudinal direction thereof, said apparatus comprising:

means for grasping and guiding a leading end of a roving coming from said roving bobbin; and means for delivering said means for grasping and guiding to said set of drafting rolls, bypassing at least a first upstream roll pair of said set and feeding and guiding said leading end into another roll pair of said set downstream of said first roll pair, subsequently threading said roving laterally into at least said first roll pair from a free side thereof.

10. The apparatus defined in claim 9 wherein each of said sets of drafting rolls is provided with at least one roving guide formed with a lateral threading slot.

11. The apparatus defined in claim 9 wherein said means for grasping and guiding said roving are components of a traveling servicing device positionable at individual ones of said work stations.

12. The apparatus defined in claim 9 wherein said means for grasping and guiding said roving includes a clamping gripper shiftable into three configurations, including a closed clamping configuration, a fully open free configuration, and an intermediate configuration forming a guiding eye for said roving.

13. The apparatus defined in claim 12 wherein said clamping gripper is provided with two clamping rollers displaceable into and out of contact with one another and drivable for the transport of said roving.

14. The apparatus defined in claim 13, further comprising a guide wheel engageable with a roll of one of said roll pairs and one of said clamping rollers of said clamping gripper.

15. The apparatus defined in claim 12 wherein two mutually opening and closing pincer-like gripping elements are provided which form said clamping gripper and are movable in the direction of transport of said roving which is grasped by said gripping elements.

16. The apparatus defined in claim 15 wherein at leaat one of said gripping elements is provided with a closing element pivotable into a position transvers to said gripping elements for forming said guiding eye.

17. The apparatus defined in claim 9, further comprising means for detecting transport motion of said roving.

18. A method of threading a roving coming from a roving bobbin at any of a plurality of work stations of a spinning machine into a running set of drafting rolls provided at each work station and having at least three roll pairs which each include an upper roll and a driven lower cylinder roll extending through said spinning machine in a longitudinal direction thereof, said method comprising the steps of:

(a) grasping a leading end of a roving coming from said roving bobbin;

(b) delivering said leading end of said roving to said set of drafting rolls;

(c) bypassing at least a first upstream roll pair of said set of drafting rolls and feeding said leading end of said roving into another roll pair furthest upstream in said set of drafting rolls which is provided with a belt guide;

(d) monitoring said leading end of said roving to determine if said roving is feeding into said other roll pair; and (e) subsequently upon determining feeding of said roving, threading said roving laterally into at least said first roll pair from a free side thereof.

19. A method of threading a roving coming from a roving bobbin at any of a plurality of work stations of a spinning machine into a running set of drafting rolls provided at each work station and having at least three roll pairs which each inclue an upper roll and a driven lower cylinder roll extending through said spinning machine in a longitudinal direction thereof, said method comprising the steps of:

(a) grasping a leading end of a roving coming from said roving bobbin;

(b) delivering said leading end of said roving to said set of drafting rolls;

(c) bypassing said set of drafting rolls and feeding said leading end of said roving into a suction device provided downstream of said set;

(d) monitoring said leading end of said roving to determine if said roving is feeding into said suction device; and (e) subsequently upon determining feeding of said roving, threading said roving laterally into said roll pairs of said set.

* * * * *